US009040880B2

(12) United States Patent
Potter et al.

(10) Patent No.: US 9,040,880 B2
(45) Date of Patent: May 26, 2015

(54) CIRCUIT ARRANGEMENT FOR SUSTAINING WATER IN CONTACT WITH A HEATING ELEMENT AT A SET TEMPERATURE OR RANGE WITHIN AN INSTANTANEOUS HOT WATER HEATER UNIT

(75) Inventors: Mark Potter, Hendon (AU); Justin Langman, Hendon (AU)

(73) Assignee: Hendon Semiconductors Pty Ltd. (AU)

( * ) Notice: Subject to any disclaimer, the term of this patent is extended or adjusted under 35 U.S.C. 154(b) by 362 days.

(21) Appl. No.: 13/807,130

(22) PCT Filed: Jul. 8, 2011

(86) PCT No.: PCT/AU2011/000870

§ 371 (c)(1),
(2), (4) Date: Jan. 30, 2013

(87) PCT Pub. No.: WO2012/003551

PCT Pub. Date: Jan. 12, 2012

(65) Prior Publication Data

US 2013/0126516 A1 May 23, 2013

(30) Foreign Application Priority Data

| | | |
|---|---|---|
| Jul. 8, 2010 | (AU) | 2010903031 |
| Sep. 22, 2010 | (AU) | 2010904278 |
| Mar. 21, 2011 | (AU) | 2011900973 |

(51) Int. Cl.

| | |
|---|---|
| ***H05B 1/02*** | (2006.01) |
| ***F24H 9/20*** | (2006.01) |
| ***F24H 1/14*** | (2006.01) |

(52) U.S. Cl.

CPC ..... *F24H 9/2028* (2013.01); *F24H 1/142* (2013.01)

(58) Field of Classification Search

CPC ..... F24H 9/2028; F24H 1/142; H05B 1/0269; H05B 1/0297; H05B 2203/021

USPC ..... 219/494, 497, 492, 501; 392/485, 465

See application file for complete search history.

(56) References Cited

U.S. PATENT DOCUMENTS

| | | | | |
|---|---|---|---|---|
| 4,314,143 | A * | 2/1982 | Bilstad et al. | 219/497 |
| 4,445,636 | A | 5/1984 | Peters | |
| 4,604,515 | A * | 8/1986 | Davidson | 392/492 |
| 5,504,306 | A * | 4/1996 | Russell et al. | 219/497 |
| 5,948,304 | A | 9/1999 | Bradenbaugh | |
| 6,246,831 | B1 * | 6/2001 | Seitz et al. | 392/486 |
| 2007/0183758 | A1 * | 8/2007 | Bradenbaugh | 392/478 |
| 2007/0289732 | A1 | 12/2007 | Pillion et al. | |

* cited by examiner

*Primary Examiner* — Mark Paschall

(74) *Attorney, Agent, or Firm* — Renner Kenner Greive Bobak Taylor & Weber

(57) ABSTRACT

An electronic circuit control arrangement to sustain water discharging from an instantaneous hot water heater at a set temperature or range having a proportional water temperature signal derived from a sensing arrangement in communication with water inlet and outlet ports so as to sense the respective temperatures at each port to provide a comparatively measurable proportional difference between the inlet and outlet temperatures set against referenced parameters, including a comparator that acts as an operable control of a switch adapted to couple and de-couple an alternating current power source to the heating element through a duty cycle of highs and lows to provide a rate to generate and maintain the appropriate coupling and/or de-coupling of the alternating current power source to and from the heating element to achieve the desired referenced temperature and/or range.

15 Claims, 8 Drawing Sheets

CIRCUIT ARRANGEMENT FOR SUSTAINING WATER IN CONTACT WITH A HEATING ELEMENT AT A SET TEMPERATURE OR RANGE WITHIN AN INSTANTANEOUS HOT WATER HEATER UNIT

TECHNOLOGY FIELD

This invention relates to the controlling arrangement of a heating element so as to provide or at least sustain water in contact with such heating element within a set temperature or range. More particularly this invention relates to such a control arrangement of a heating element the kind to which are installed within instantaneous hot water heater units.

BACKGROUND DISCUSSION

Conventionally when heated water needs to be dispensed from a faucet from a hand wash basin and so forth it is usually derived from a stored location where it is pre-heated through an electrical or gas hot water system.

The problem with such arrangements is that not only do such water systems require continuous energy input to maintain the stored water at a desired temperature level, they are also by their very nature quite bulky as the water under heat needs to be initially stored within a reservoir prior to being sent across to the faucet for discharge.

As there is a storage water component as part of the arrangement it means that it often needs to be positioned away from the faucet therefore there are the associated costs and design of bringing the pipe-work from the stored water locations to the faucet for usage, which as expected often leads to measurable heat lost as well as potential water loss and so forth unless such flow on pipes are correctly kept in up to date maintenance.

More recently there has been a move towards what is known in the trade as instantaneous water heaters wherein the heating starts as soon as water enters the unit for immediate discharged from the faucet or tap.

In such arrangements incoming water into the instantaneous hot water unit is immediately heated by electric elements wherein the power to the elements is provided as soon as the water flows through the unit itself making contact with the element, wherein the heating is then withdrawn from the element as soon as the water tap is closed.

As can be seen with such instantaneous hot water heaters, energy is only consumed while water is actually flowing through the unit, advantageously therefore providing significant energy savings, as well as greater design flexibilities in that such units can be conveniently installed either within a hand wash basin or points close by therefore reducing the problems introduced above caused by withdrawing water from pipes run at a distance from stored water at a different location from the hand basin.

Arguably current instantaneous hot water heater units for low volume use, such as with hand basins and so forth, provide improvements over and above traditional hot water gas and electrical units on the basis of energy consumption, installation and flexibility of use making them suitable to be incorporated into hand basins and sinks in places such as bathrooms, restaurants, toilets, hospitals and literally any place where hand washing is required.

Nonetheless there are problems with these kinds of instantaneous hot water heater units. As introduced above for the most part many of these units operate the heating element to induce heat energy into the water by switching means that is connected directly to the operational water flow through the unit itself.

Power to the heating elements is instigated upon the operation of the faucet to discharge the flow and the unit then automatically cuts power to the heating element once discharge is complete by turning the tap off.

The person skilled in the art will appreciate that such a switching arrangement to supply power to the heating element to establish the temperature lacks any type of precision control.

The switching ON and OFF of power to the heating elements is very much mechanical and arbitrary in nature, and if some type of consistent and accurate temperature or temperature range is to be established for the discharged water improved design is required.

Under such circumstances these kinds of instantaneous hot water units as they simply provide a set power level to the heating element upon activation, are unable to differentiate between the temperature of the incoming water into the unit, and consequently the actual discharged water will be released at a proportional temperature to that of the incoming water, which has been instantaneously or immediately heated by the electrical elements.

For example conventional instantaneous hot water units in theory provide the operator the opportunity of selecting a particular temperature to which the water to be discharged from the tap or faucet should be in the range of.

Based on this desired temperature selection of the operator the heating of the electrical elements by the unit is simply driven by a current and/or voltage depending upon the magnitude of the desired temperature to that water entering the unit, upon activation of a tap or so forth.

Nonetheless no consideration is given to the actual temperature of the incoming water to the unit, so if there is a differentiation, for example water at 16° C. as opposed to water at 22° C., the discharge temperature of such water passing through these kinds of instantaneous hot water units will be substantially different, albeit for both scenarios they are expected to be the same for the end user.

Given these instantaneous hot water heater units offer such energy efficiency and by design make them so conveniently installable either above or under a sink for a hand wash basin, the fact that the actual immediate heating of the water lacks precision in actual discharged heating of the water from the outlet does raise some real concerns, and also potentially limits the application of such units for some environments.

For example many workplace, occupational health and safety standards require that outlet water temperatures do not exceed a particular threshold. Under Australian Standard AS3498-2009 for the authorisation requirements for plumbing products associated with water heaters and hot water storage tanks, temperature delivery requirements state that delivery temperature at the outlet of the appliance shall be factory set to no greater than 50° C.

As introduced above typically when the heating element is turned on when the tap is opened and water is allowed to flow therethrough, full power of the elements is applied to the water regardless of the flow rate, and regardless of the temperature of the input water.

At any given flow-rate, the amount of energy applied to water will cause the water temperature to increase by a fixed amount at that flow rate. Consequently at any given flow rate and the element power input, the difference between the inlet and outward temperatures will be constant, but the absolute value of the outlet water temperature will then depend on the inlet water temperature.

For instantaneous hot water heater units under certain flow conditions and values of incoming water temperatures, the amount of energy being applied to the water, the outlet temperature may potentially rise above maximum allowed by local standards.

Still further, if the incoming water temperature is much higher than expected, which is quite possible if the water supplied to the heating unit comes from a hot summer external environment, there is the possibility that full power to the heating element during the ON/OFF sequence of the tap or faucet could present a real risk that water discharged from the outlet presents the risk of scalding of the hands of the user.

While some instantaneous water heaters may include flow and temperature sensors linked to mechanical switches, differential pressure switches that detect when the tap is on by the pressure differential across the heater and so forth, the fact still remains that during standard factory or operational settings the unit will be designed to switch between ON and OFF cycling which will therefore introduce only full power to the heating elements thereby taking no consideration of incoming water temperature to the unit which means there is no precision or control of discharged water temperature.

Such lack of control in being able to precisely set a temperature or a temperature range of water discharged from the outlet of these instantaneous hot water heater units makes their application in places such as restaurants, hospitals, factories where workers need to continually sterilise their hands and so forth, make the use of these conventional units inappropriate at present, as such environments demand that the discharge temperature of the water from the unit not exceed a particular limit but also importantly be able to be sustained at a particular temperature for a period of time so that an operator washing his or her hand from the basin using the heater unit meets the general requirements that demand that the hand is continually washed under a certain temperature condition for a certain period of time.

While there are electro-mechanical switches which for the most part use passive components to detect changes in temperature and therefore able to open or close a contact when a specified level is reached, these switches directly activate the power being sent to the heating element without requiring an inter-connected controller or electronic circuit.

While such electro-mechanical switches may appear to provide cost effectiveness and design simplicity, it is well recognised the mechanical resistance of the individual parts often causes the switch to commute back not to the original actuating position but at a later release position introducing hysteresis into the control and thereby the ability to accurately detect a small temperature change so as to provide the necessary ON and OFF sequence to the heating element to generate and sustain water at a particular set temperature or range.

It is well recognised also that electro-mechanical switches move gradually from their initial position to actuating position and on to its final position and vice versa hence there are real transition zones in the turning ON and OFF of the power to the heating element of the instantaneous hot water heater unit, again leading to severe deficiencies in the accuracy and precision of being able to sustain and limit water at the outlet of the unit to a particular set temperature or range.

Therefore there remains a need in the technology associated with these instantaneous hot water heater units to provide an improved controlled switching arrangement of the ON and OFF sequencing of power to the heating element, such that water discharged from the unit can be sustained at a set temperature or range regardless of the inlet water temperature and without the pitfalls associated with the limiting factors connected with electro-mechanical switches and those related thereto discussed above.

It is an object of this invention to provide such a controlled arrangement to be able to sustain water in contact with a heating element at a set temperature or range within an instantaneous heater unit that is able to overcome the problems introduced precedingly.

Another of object this invention is to provide a means and method for controlling the temperature at the outlet of a hot water heater unit even in cases where the inlet temperature and water flow are varying and to do this proactively rather than relying on control responding to subsequent breaches of set temperature parameters for the instantaneous hot water heater unit sensed at the output.

Further objects and advantages of the invention will become apparent from a complete reading of the enclosed specification.

SUMMARY OF THE INVENTION

In one form of the invention there is provided an electronic circuit arrangement adapted to sustain water in contact with a heating element at a set temperature or range within an instantaneous hot water heater unit, said circuit arrangement including; a comparator, a reference input into said comparator adapted to provide a current and/or voltage being dependent on an operational temperature of the water to be heated within the hot water heater unit for discharge therefrom; a sensor input arrangement to provide a further input signal into said comparator, wherein the further input signal is adapted to provide a current and/or voltage dependent upon the magnitude of a temperature of water measured from a discharge outlet of said hot water heater unit, said sensor input arrangement including communication with a thermistor and an output feedback signal from said comparator so as to determine by way of the comparator differentiation with the reference input signal that a proportional temperature range has been established relative to the selected desired operational temperature determined by the referenced input signal to said comparator; a switch in operable communication with said comparator, said switch electrically adapted to couple and de-couple an alternating current power source to the heating element of said heater unit so that when the switch is in an ON state, the heating element is coupled to the alternating current power source and conversely when the switch is in an OFF state, the alternating current power source is de-coupled from the heating element;

whereby once the measured reading of the sensor input signal measures that the heating element is now in the proportional controlled temperature range this information is communicated to a switch operational controller that provides an output signal from the comparator wherein said signal provides a duty cycle of HIGHs and LOWs that is translated by the switch to a switching time sequence of ONs and OFFs at a rate to generate and maintain the appropriate coupling and/or de-coupling of the alternating current power source to and from the heating element to achieve the desired selected referenced temperature and/or range once the sensed measured temperature becomes within the range of the proportional controlled temperature range.

Advantageously the electronic circuit arrangement is able to bring precision and control to sustain the temperature discharging from the heating unit at a desired set temperature.

The electronic circuit arrangement is able to control characteristics such that the dutycycle of the alternating current power source applied to the heating element inside the heater unit is proportional to the difference between the sensor temperature at the water outlet pipe, and the set (preferably limiting) temperature selected by the arrangement established by the referenced input signal to the comparator whereby the levels of current and/or voltage provide a degree of precision as to a selected preferred temperature or range.

As the temperature of the outlet water increases towards the set point, then the dutycycle of the power applied to the element is proportionally reduced.

Advantageously by selecting a suitable switching rate, the heating element of the heating unit can be cycled ON and OFF at a rate that maintains constant or sustaining outlet water temperature.

In preference the switch is a TRIAC.

In preference the circuit arrangement is configured using a thick-film printing process, depositing the circuit on a ceramic substrate.

In preference the ceramic substrate of the deposited circuit arrangement for the invention is mountable on a metal plate, preferably attached to an outlet of the water pipe extending from the instantaneous hot water heater unit.

By being able to employ an electronic circuit arrangement to control the level of power being sent to the heating element, thereby controlling the temperature of the water making contact within the heating unit rather than the use of electo-mechanical switches and/or more conventional mechanical control through the use of mechanical componentry, means that the actual control of the heating arrangement for the unit can be of relatively small dimensions.

As introduced above one of the advantageous features of the instantaneous hot water heater units per se, was the ease in which they could be so conveniently installed either above or below conventional hand wash basins.

Advantageously through the precision electronic control utilising the electronic TRIAC switch which controls the load current to the heating element, means it can be conveniently deposited upon a ceramic substrate and then connected without any cumbersome reconfiguration structurally within the heating unit to accommodate its positioning up against the outlet water pipe.

The ability to provide a dutycycle that is going to be able to provide power to the element that is proportional to the difference between the sensed temperature at the water outlet pipe and the set limiting temperature decided for the operation of the unit, means that there could be a considerable amount of switching required by the TRIAC control which will conversely generate heat.

Advantageously as the circuit arrangement is deposited on the ceramic material and then mounted on a metal mounting plate to the metal pipe, the installation in itself then provides a means in which heat generated by the dutycycle switching of the signal provided for by the TRIAC can be channelled away through the artificially created heatsink, that being the metal mounts and also the outlet water pipe.

The use of the ceramic substrate provides electrical isolation, with suitable creepage distances, between the mains power circuit and the earth water piping. Thermal connection between the solid state AC switching device of the TRIAC controller and the water, effectively uses the water and piping as introduced above as a heat sink for the TRIAC.

Where in the past the size of these kinds of circuit arrangement using solid state AC switches like TRIACs were limited by the physical size of the heatsink required to maintain the TRIAC junction temperature within its operating specification when controlling load current now as introduced above, heatsinking the TRIAC by the ceramic PCB to the water pipe removes the need for a large aluminium ended heatsink, as water passing through the unit would have a very high specific heat that makes it an excellent heatsink.

In addition the power dissipated by the TRIAC is transferred to the water, and it helps to heat the water so that none of the energy in the TRIAC or the control circuit is lost outside the system making for a very efficient control method.

Mounting the sensor together with all the other electronic components on the ceramic substrate simplifies the mounting of the sensor and eliminates the requirement for a separate temperature probe, with all the necessary mounting and connection and isolation requirements.

By avoiding the use of a separate temperature sensing probe, together with the necessary isolation and mounting requirements, the thermal mass of the sensor can be reduced, improving its response to temperature changes of the outlet water. This is advantageous for reducing temperature overshoot of the water when the element first turns on.

Preferably electrical connection to the circuit control arrangement is made by means of flying leads, or spade terminals attached to the ceramic. Preferably connections are provided for to compensate for active, neutral and load wherein the load may be a single or plurality of heating elements within the heating unit.

In preference the sensor input arrangement to provide a signal into the comparator wherein said feedback signal magnitude of current into the comparator is determined by a series of resistors.

While it is possible for the feedback signal from the TRIAC to be introduced back into the sensor input of the comparator by being just fed back through a single resistor, preference is for the current into the two comparator inputs, that being the sensor input and the reference input, to be in the order of 10's of uA.

If feedback from the TRIAC was to pass through just a single resistor convention would require the value to be extremely large in the hundreds of Mohms, which may add significant cost to the circuitry of the arrangement.

In preference the feedback signal form the TRIAC pass a feedback network that includes three resistors Ra, Rb and Rc that applies part of the output voltage, that being the voltage across the TRIAC, back to the sensor input of the comparator.

In preference resistors Ra and Rb form a voltage divider to set up the required magnitude of the feedback signal with resistor Rc in parallel converting the voltage at the junction of Ra and Rb to an input current into the comparator.

In preference values for resistors Ra, Rb and Rc would be in an extended range about these respective values 2M2, 22K and 220K.

In preference the thermistor is a negative temperature coefficient (NTC) thermistor.

In a typical application only the output temperature is measured. This introduces various problems including temperature overshoot and oscillation. This is due to the inherent thermal delay between applying power to the element, the element heating up, and then the transfer of heat from the element to the water. This means the water is already hot before the output sensor 'sees' that the water is hot, hence it overheats before controlling. Vice-versa, when the output water cools down, it takes some time for the sensor to 'see' this, and apply power to heat the water.

If the flow rate of the water changes, then the amount of heat energy input to a specific volume of water will also change, as it is in contact with the element for a different amount of time. If the flow rate increases the time decreases, so the water temperature decreases. Vice-versa, if the flow rate decreases the time increases, and the water temperature will rise.

Heaters of different power will deliver different amounts of heat energy to the water. A higher power heater will deliver more energy, hence hotter water. A lower power heater will deliver less energy, hence colder water.

When the heater power is fixed, and the flow rate is fixed, the only variable is the input water temperature.

If the input water temperature varies, the output will also vary, as the amount of heat energy input to the water is still the same. So if the input water temperature goes up by 10 degrees Celsius, the output temperature will also go up 10 degrees Celsius.

This is an undesirable outcome, as the water will be hotter than intended and could cause injury through scalding.

Measuring only the output affords some protection, but as mentioned above, it will still overshoot and the output may get too hot if the control doesn't adequately compensate for the increased inlet water temperature.

By measuring the temperature of the inlet water, it is much easier to account for any changes in inlet water temperature, and control the heater accordingly to maintain the desired output water temperature.

So an additional temperature sensor is used to measure the inlet water temperature. This signal is processed by the comparator, to modify the desired control on the heater element thus controlling the output water to the desired temperature.

The key advantage the two-sensor concept is that the control already knows how much heat energy needs to be applied to the water, without having to 'wait' for the heated water to be 'seen' by the output sensor. In this way, only the amount of energy required is used to heat the water to the desired temperature, thus there is no overshoot, and any variations in inlet water temperature are accounted for before the water exits the heating unit.

This improves safety and performance.

When using only an input temperature sensor, since only just the amount of energy that is required is used, the initial heatup of the water is slower than using just an output sensor, which would normally apply full power to the heating element and water until it 'saw' hot water.

By using two sensors, one on the input, and one on the output, the control can now quickly account for any variations in input water temperature, and also heats up very fast due to the output sensor 'seeing' cold water at first use of the appliance.

By adjusting the ratio of input sensor bias to output sensor bias, a desirable performance characteristic can be obtained, whereby the control applies full power initially to the cold water, but as the water approaches the desired control temperature, the control reduces the amount of heat energy delivered to the water, preventing the water temperature from overshooting.

The dual sensor bias method coupled with the proportional duty cycle method allow very accurate control characteristics to be realised, for any input temperature.

Subsequent trialling by the applicant has now become suggestive that the inlet temperature and water flow rate can vary over a wide range, which in turn varies the time delay to sense the outlet water temperature.

The consequence of such inadequacy is that rather than having water discharged at a constant set temperature or at least one within a preferred range there is a tendency for control circuitry to act upon sensed temperature once referenced set parameters have been breached.

The problem with a control arrangement that acts in response to set parameters being exceeded or underscored is that the water actually flowing through the instantaneous water heater at that moment of time will be at a temperature which is outside the set range.

For example once water enters the instantaneous hot water heater unit and remains within the heating coils there within to be heated accordingly this in itself is a volume of water.

If the control arrangement is relying on output temperature levels of water being discharged from the heating unit, even in scenarios where proportional rates of difference are being used with the inlet measured temperature, the fact remains that if the outlet temperature is sensed as too high against a referenced amount, the control unit then takes subsequent action to reduce the amount of energy being sent to the heating elements.

However as is to be expected the heating unit is still full of water within the coils so the discharge of at least a substantial proportion of that water will be at a higher temperature outside set parameters as for the most part discharge of water flow from the heating unit is automatically activated by the fact that a user requires the operation of the heater unit.

Therefore it is easy to see that there will be not only a moment of time but in fact a volume of discharged water that will exceed set temperature parameters.

The problem then becomes exacerbated by the fact that in response to the sensed high temperatures at the discharge once energy levels to the heating elements are reduced or withdrawn do overcome the breach of set temperature parameters, this can lead to set temperature levels falling below those that are required.

Once again the actual sensing of the temperature below required levels only becomes recognisable after the fact, which means that the water remaining inside the instantaneous water heater for the most part upon discharge will be below set parameters wherein once again in order to control this variation high energy levels will then be sent to the heating elements in order to try and artificially arrest this situation as soon as possible.

Consequently rather than having a smooth predictable water temperature discharge level there is a substantial fluctuation resulting in consistent overshooting and underscoring of the preferred set temperature range.

Therefore as can be seen from the preceding there needs to be a preferred control arrangement put into place that can appreciate that inlet temperature and water flow can vary over a wide range and the consequences of such variations need to be predicted before actual set parameters are breached so as to avoid any time delay in an unfavourable sensed outcome in order to rectify the unfavourable water temperature that has been measured at the outlet.

Accordingly in one form of the invention there is provided an electronic circuit control arrangement adapted to sustain water discharging from an instantaneous hot water heater, said circuit arrangement including:

a proportional water temperature signal derived from a sensing arrangement wherein said sensing arrangement is in communication with both a water inlet port and an outlet port so as to sense the respective temperatures at each port so as to provide a comparatively measurable proportional difference between the inlet and outlet temperatures set against referenced parameters;

a proportional water temperature rate of change signal derived from the water proportional temperature signal comparatively referenced with short term rate of change parameters of said proportional water temperature signal;

an adjustment signal derived from said proportional water temperature signal comparatively referenced with an offsettable pre-determined parameter;

a comparator;

a first input into said comparator derivable from the proportional water temperature signal;

a second comparator input derived from the summing together of both the proportional water temperature rate of change signal and the adjustment signal.

Such that the comparative relationship between the first and second input signals to the comparator provide an operable control of a switch adapted to couple and de-couple an alternating current power source to the heating element of the said heating unit so that when the switch is in an 'on' state, the heating element is coupled to the alternating current power source and conversely when the switch is in an 'off' state, the alternating current power source is de-coupled from the heating element whereby the signal established from the comparator derives from the first and second input signals provides a duty cycle of highs and lows that is translated by the switch to a switching time sequence of 'ons' and 'offs' at a rate to generate and maintain the appropriate coupling and/or de-coupling of the alternating current power source to and from the heating element to achieve the desired referenced temperature and/or range.

An advantage of such arrangement is that through the introduction of deriving both a proportional water temperature rate of change signal which is able to reference short term rate of change of the proportional water temperature signal that was derived from the dual sensor arrangement and then combining it with the adjustment signal which is able to utilise long term error analysis which can match the rate of change so as to then provide an input signal to the comparator so that the correct duty cycle when read with the current sensed proportional water temperature signal presents a duty cycle which will maintain the appropriate coupling and/or de-coupling of the alternating current power source to and from the heating element in real time.

Advantageously the heating element is not being heated in response to the actual temperature at the output, but rather being heated to an expected set temperature at the output, based on the signal coming from the sensed signal, rate of change signal and the adjustment signal.

Under this control arrangement the circuit is responding to measured signals and then based on those readings acting instantaneously to keep not only the water being discharged from the hot water heater unit at the set temperature, but also the water within the unit itself.

Advantageously by being able to comparatively work not only with the actually measured proportional water temperature at both the inlet and outlet, but observing the rate of change of this measured water temperature and then utilising a predictable outcome based on set references there is no overshooting or underscoring set temperature levels.

As there is no overshooting or underscoring set temperature levels there is no subsequent extreme action taken by the control circuit which would see unnecessary de-energising or overcharging of the heating elements in order to compensate temperatures exceeding or underscoring set temperature levels.

In preference the proportional water temperature signal, the proportional water temperature rate of change signal and/or the adjustment signal are DC derived.

In preference DC conditions for the proportional water temperature signal, the proportional water temperature rate of change signal and the adjustment signal are provided for a Zener diode between the active of an alternating current power source and the comparator.

In preference the alternating current power source Zener diode providing the DC conditions for the respective signals is the same alternating current power source which is adapted to be coupled and de-coupled from the heating element to provide the necessary heating energy to heat the water within the instantaneous hot water heater unit.

In preference the Zener diode is reversed biased against the active of the alternating current power source and working in conjunction with a series configured resistor wherein a diode is placed in parallel between the Zener diode and the series configured resistor so that positive half cycles of the alternating current power source are passed on to the DC operable portion of the circuit.

In preference current generated during the positive half cycle passing through the diode set parallel against the Zener diode and the series resistor stemming from the active cycle of the alternating current power source is in communication with a capacitor chargeable and dischargeable so as to provide required DC levels in between the positive half cycles of the alternating current power source.

In preference the sensor arrangement includes negative temperature coefficient thermistors adapted to sense water at each of the water inlet port and outlet port respectively.

In preference the inlet and outlet water temperatures proportionally conditioned are then fed into an amplifier.

An advantage of such an arrangement is that by including as part of the control circuitry and amplification of the sensed temperature differences between the inlet and outlet temperatures provides a sensing arrangement that can be particularly sensitive.

As is to be expected general monitoring of measured temperature levels of the water does not need a desired level of sensitivity if users of the heating unit are quite happy to see significant fluctuations and differences in the water temperature being discharged from the outlet.

Nonetheless the whole purpose of the circuit control provided for in this invention realises that the ability to be able to present a smooth non-oscillating temperature level to the water being discharged from the heating unit is very much dependent on select sensitivity of the proportionally derived sensed temperatures taken from both the inlet and outlet ports as the rate of change of the proportional water temperature signal will play a part in combination with the adjustment signal which will lead to a degree of offsetting so that not only is the proportional water temperature signal being considered as providing an expected duty cycle to control power to the heating elements but this is being read in context with signals that will modify or be compared thereto the proportional water signal temperature and this can only be done if there is a high degree of sensitivity.

In preference the negative temperature coefficient thermistors would have approximate ratings of 47 k at 25° C.

In preference the adjustable signal is in operable communication with a time delay arrangement once the alternating current source is first coupled to the heating element for heating.

In preference the time control arrangement includes a capacitor and a resistor whereby the time of the delay will be determined by the values of both the capacitor and resistor.

An advantage of such an arrangement is that on initial powering up there will always be the requirement to bring the water at the inlet up much closer to the required temperature range for discharge.

The purpose of an instantaneous hot water heating unit is just that, to instantaneously heat water to a set level.

Therefore for the most part there will always be the requirement to immediately send the alternating current power source through the heating element to bring the inlet temperature up close to the set temperature within the relevant range.

If the offset adjustment signal was part of the overall circuit control the moment the instantaneous hot water heater unit becomes operable it may want to overreact to the measured conditions provide there to it and hence it would be far more advantageous to disconnect for a period of time any offsetting immediately on start up.

Advantageously by introducing the time delay the offsetting characteristics of the control circuit only become operable after a predetermined time has lapsed which if appropriately defined will be close to the sensitive adjustment range as the value of the water temperature within the unit heads close towards the preferred set value.

DETAILED DESCRIPTION OF THE INVENTION

Figure 1:
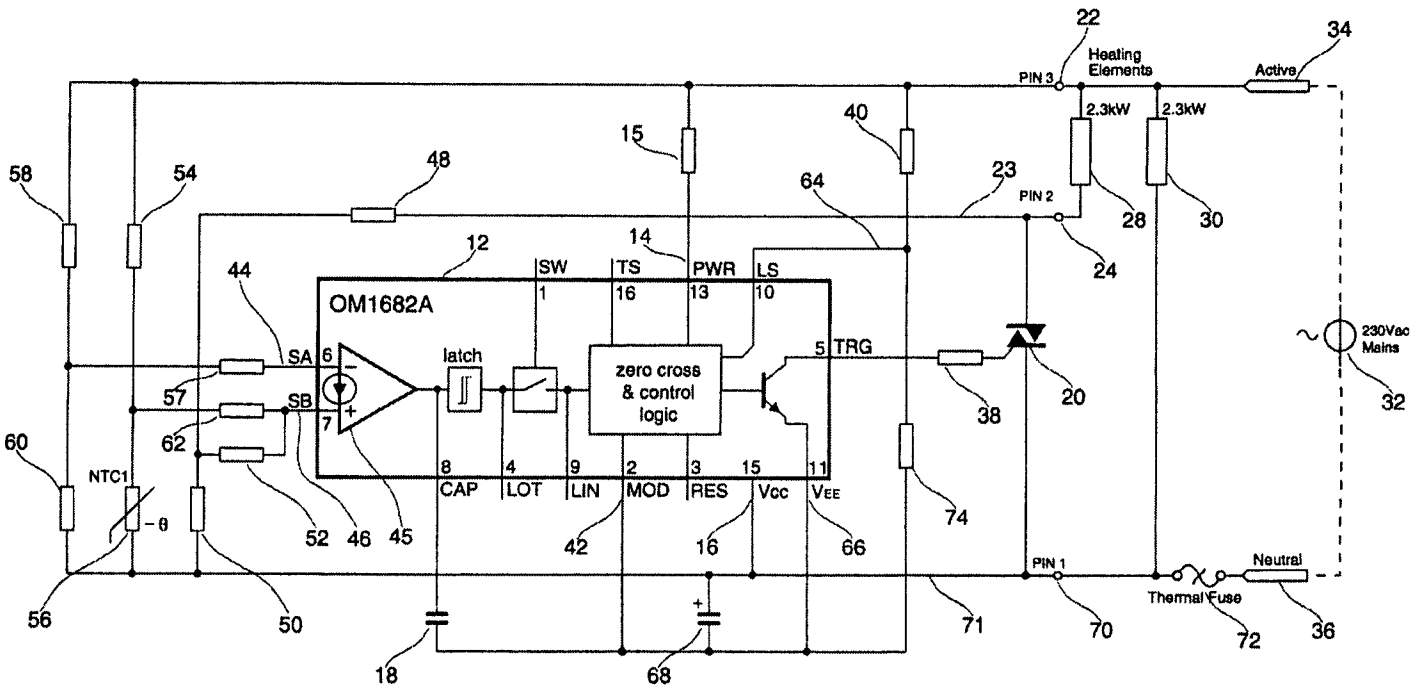
FIG. 1*a* is a schematic circuit arrangement diagram of a preferred embodiment including a single-sensor linear controller.
FIG. 1*b* is a schematic circuit arrangement diagram development of the preferred embodiment shown in FIG. 1*a* including a dual-sensor linear controller.
FIG. 1*c* is a schematic circuit arrangement diagram development of the preferred embodiment shown in FIG. 1*b* including a Proportional Integral Derivative (PID) controller.

Referring to the illustrations now in greater detail.

In the preferred embodiment of the invention power is provided to the instantaneous hot water heater unit (not shown specifically in the illustrations) via pressure differential switches, preferably the type of sensor used to detect that the tap is being turned on. The unit is only powered when the pressure switch detects the water is flowing, and so consumes no power when the unit is OFF and no water is flowing.

The circuit arrangement presented in FIG. 1*a* provides a means in which the powering can be precisely controlled to the heating element of the instantaneous hot water heater unit so as to sustain the water at a set accurate temperature range when discharged from the unit.

The general circuit arrangement includes a TRIAC (20) which is controlled by an integrated circuit OM1682A (12).

The invention per se does not rely on the integrated circuit (12) referred to as OM1682 A, this particular integrated circuit simply provides the functionality required so that the two inputs (44) and (46) to be discussed following herewith can undergo a measured differential reading determined by the comparative capabilities of the integrated circuit (12) so that in conjunction with the components configured about the integrated circuit (12) the ability is then provided for the complete arrangement to sense temperature of the heating element within a proportional temperature control range, so that the negative feedback from the TRIAC which is caused by the voltage present across the TRIAC when it is OFF is applied to an input (46) whereby causing the TRIAC to turn ON. Conversely the feedback signal will then be removed when the TRIAC (20) is turned ON, allowing the bridge signal into the input (46) to the comparator of the integrated circuit (12) to turn the TRIAC OFF.

In each case the feedback voltage contributes to a changed state of the TRIAC whereby the negative feedback causes the controller to oscillate, with a dutycycle that depends on how far the sense temperature is away from the set point.

Mains supply voltage is applied to terminals, active (34) and neutral (36).

The TRIAC (20) is used to control the supply of power to the heating element (28), which in this preferred embodiment is a 2.3 kW element at 240V.

Pins (22) and (24) provide an input bridge (26) across the heating element (28).

In some embodiments the instantaneous hot water heater unit will have a series of individual heating elements. In the circuit arrangement shown in FIG. 1 there is an additional 2.3 kW heating element (30) not connected to the TRIAC control.

The reason being is that during the heating cycle there is always going to be a base load minimum temperature required, so a certain level of power will always have to be used for the heating elements if the unit is going to get anywhere close to the desired selected operational temperature range as referenced.

The purpose of this arrangement is to offer precision control once the temperature of the heating element gets within a preferred proportional temperature range about the set operational temperature per se.

Hence rather than simply switching one large heating element "on" and "off" by dividing up the heating elements it is then possible to obtain much greater accuracy as the circuit is controlling the heating element with much lower wattage than the overall heating system (for example 2.3 kW plus 2.3 kW), so consequently once within the proportional control range, the duty cycle can be sent to power the a single element which is proportional to the difference between the sensed temperature at the water outlet and the set limiting temperature defined by the control operational set referenced temperature.

That means the level of switching should be minimized and with reduced amounts of switching we can then utilise TRIACs of much lower rating given that the heat generated will be far lower due to reduced amounts of switching required in order to select a suitable switching rate so that the element can be cycled ON and OFF at a rate that maintains the constant outlet water temperature.

The output signal from the integrated circuit (12) through to the TRIAC (20) passes through resistor (38).

Resistors (48), (50) and (52) form part of the feedback network which applies part of the output voltage, the voltage across the TRIAC back to the input (46).

Both inputs (44) and (46) into the integrated circuit (12) which is providing the comparative functionality so that measurable differentials can be determined between the inputs in order to provide output control to the TRIAC switch (20) are designed to handle AC signals, so signals derived from the input resistor bridge (58), (60) and (57) for the referenced input (44), and resistor (54), the negative temperature coefficient thermistor (56) and resistor (62) into the sensor input (46) to the comparator of the integrated circuit (12) are all AC signals, as they are derived directly from the AC mains voltage connected at terminals (34) and (36).

For the most part resistors (48) and (50) form a voltage divider, to set the magnitude (attenuation) of the feedback signal (23) from the TRIAC (20).

Resistor (52) converts the voltage at the junction of resistors (48) and (50) to an input current into the sensor input (46) to the comparator of the integrated circuit (12).

VCC shown generally as (16) (or neutral/common) is referenced for all the input signals into both the sensor input (46) and the referenced input signal (44) of the comparator of the integrated circuit (12).

For the most part for calculation purposes, inputs for both (44) and (46) can be considered to be mutual or common potential referred generally as "virtual common" inputs, in a similar manner to which operational amplifiers inputs can be considered "virtual earth".

As can be seen from the schematics the signal (23) derived from the TRIAC (20) is applied to the sensor input (46).

As introduced above this is referred to as negative feedback, because the voltage present across the TRIAC when it is OFF is applied, via the resistor divider of resistors (48), (50) and (52), to input into the sensor input (46) which causes the TRIAC to turn ON.

Conversely the feedback signal is removed when the TRIAC turns ON, allowing the bridge signal into the sensor input (46) to turn the TRIAC OFF. As the person skilled in the art can then appreciate from the circuit arrangement in each case the feedback voltage contributes to a change of state of the TRIAC.

In preferred embodiments the values of resistors (48), (50) and (52) have relevance in both the cost and the operating conditions required for the circuit.

By adding the resistors (50) and (52) as part of the feedback network of part of the output voltage across the TRIAC means that resistor (48) can have a much lower resistance value.

It is preferable that the current into the inputs (44) and (46) of the comparator as introduced precedingly are in the order of 10's of uA. Values for resistors (48), (50) and (52) preferably with measured resistance in the range of 2M2, 22K and 220K respectively provide the current into input (46) at levels suitable for operation of the integration circuit (12).

Potentiometers may also be used to provide adjustment of a temperature setting which may be useful in certain water heater applications.

As the person skilled in the art will appreciate in an arrangement which is providing precision controls one can not afford to lose such tolerance in the control temperature, so this arrangement effectively removes the potentiometer tolerance from the equation.

For the most part the sensor input (46) as well as the reference input signal (44), are treated just like any other general inputs into a comparator, with the exception that these inputs (44) and (46) can accept AC signals, although based on the configuration presented in FIG. 1*a* they will only use the positive polarity portion of the signals while the negative polarity portions of the signals are clamped and do not contribute to the output signal.

As is to be expected the comparator works on input currents not voltages based on this preferred schematic representation. The actual voltages on the inputs (44) and (46) provide little measurable characteristics, because they are effectively at neutral or common potential.

A capacitor attached to the integrated circuit (12) is represented as (18), which is connected to the output of the comparator and is charged in either a positive or negative direction depending on the net difference between the two input currents of comparator (45) at inputs (44) and (46). In this way the difference current is integrated over time, providing filtering of the input signals, resulting in excellent immunity to RF (radio frequency) and other forms of mains-born transient interference.

VCC is represented at (16), the power represented at (14) is supplied by voltage dropping resistor (15) from the mains active supply (34), with DC supply filter capacitor (68) connected between the negative VEE supply rail (66) and positive VCC supply the rail (71) which terminates in a thermal fuse (72) at the pin (70) which is engaged by the neutral terminal of the mains power. A mode select is available at (42), and resistors (40) and (74) connected between the mains active supply (34) and the negative DC supply rail VEE (66) provide mains synchronization & zero-crossing information for the TRIAC control IC (12).

Figure 1B:
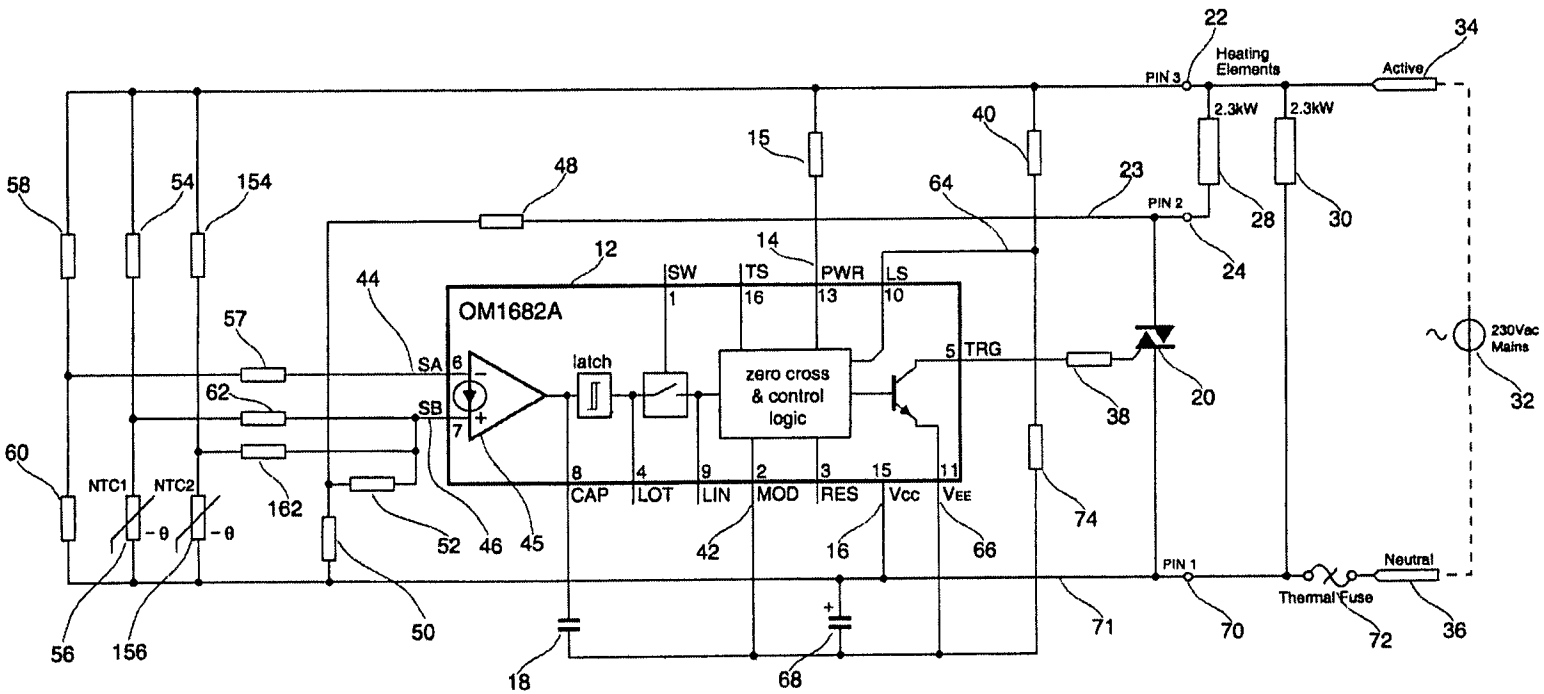

FIG. 1*b* is a schematic circuit arrangement diagram development of the preferred embodiment shown in FIG. 1*a* including a dual-sensor linear controller. An additional negative temperature coefficient thermistor (156) and voltage divider resistors (154) and (162) have been introduced.

Heaters of different power will deliver different amounts of heat energy to the water. A higher power heater will deliver more energy, hence hotter water. A lower power heater will deliver less energy, hence colder water.

When the heater power is fixed, and the flow rate is fixed, the only variable is the input water temperature.

If the input water temperature varies, the output will also vary, as the amount of heat energy input to the water is still the same. So if the input water temperature goes up by 10 degrees Celsius, the output temperature will also go up 10 degrees Celsius.

This is an undesirable outcome, as the water will be hotter than intended and could cause injury through scalding.

Measuring only the output affords some protection, but as mentioned above, it will still overshoot and the output may get too hot if the control doesn't adequately compensate for the increased inlet water temperature.

By measuring the temperature of the inlet water, it is much easier to account for any changes in inlet water temperature, and control the heater accordingly to maintain the desired output water temperature.

So an additional temperature sensor is used to measure the inlet water temperature. This signal is processed by the comparator, to modify the desired control on the heater element thus controlling the output water to the desired temperature.

The key advantage the two-sensor concept is that the control already knows how much heat energy needs to be applied to the water, without having to 'wait' for the heated water to be 'seen' by the output sensor. In this way, only the amount of energy required is used to heat the water to the desired temperature, thus there is no overshoot, and any variations in inlet water temperature are accounted for before the water exits the heating unit.

This improves safety and performance.

When using only and input temperature sensor, since only just the amount of energy that is required is used, the initial heatup of the water is slower than using just an output sensor, which would normally apply full power to the heating element and water until it 'saw' hot water.

By using two sensors, one on the input, and one on the output, the control can now quickly account for any variations in input water temperature, and also heats up very fast due to the output sensor 'seeing' cold water at first use of the appliance.

By adjusting the ratio of input sensor bias to output sensor bias, a desirable performance characteristic can be obtained, whereby the control applies full power initially to the cold water, but as the water approaches the desired control temperature, the control reduces the amount of heat energy delivered to the water, preventing the water temperature from overshooting.

The dual sensor bias method coupled with the proportional duty cycle method allow very accurate control characteristics to be realised, for any input temperature.

Figure 1C:
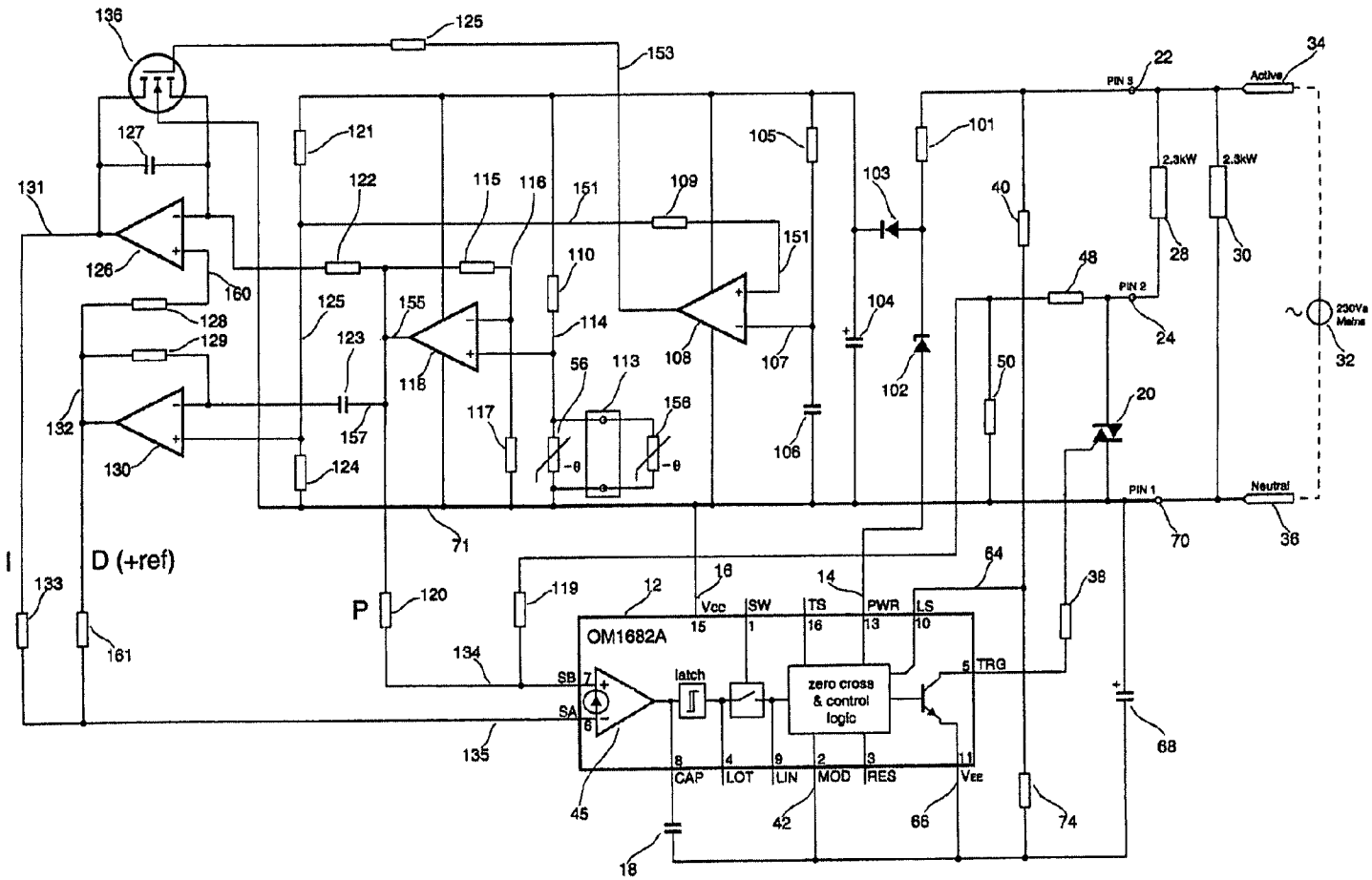

FIG. 1*c* is a schematic circuit arrangement diagram development of the preferred embodiment shown in FIG. 1 *b* including a Proportional Integral Derivative (PID) controller.

The two inputs (134) and (135) to be discussed following herewith can undergo a measured differential reading determined by the comparative capabilities of the integrated circuit (12) so that in conjunction with the components configured about the circuit shown in FIG. 1*c* the ability is then provided for the complete arrangement to measure and provide relevant signals so that the comparator (45) provides an output from the integrated circuit (12) through a resistor (38) to a TRIAC (20) so that the negative feedback from the TRIAC (20) which is caused by the voltage present across the TRIAC when it is off is applied to the input (134) thereby causing the TRIAC to turn on. Conversely the feedback signal will then be removed when the TRIAC (20) is turned on allowing the bridged signal (134) into the comparator (45) of the integrated circuit (12) to turn the TRIAC off.

In each case the feedback voltage contributes to a changed state of the TRIAC whereby the negative feedback causes the controller to oscillate with a duty cycle that is dependent on the referenced comparative measured signals (134) and (135) inputted into the comparator (45) of the integrated circuit (12) which will be discussed below.

Mains supply voltage is applied to terminals active (34) and neutral (36).

The TRIAC (20) is used to control the supply of power to the load which in the case of an instantaneous heating water unit would be a heating element (not shown) or a series thereof.

The alternating current power source (34), (36) includes resistor (101) and Zener diode (102) which is parallel with an intermediate configured diode (103) wherein the reverse biasing of the Zener diode (102) allows that during positive half cycles of the alternating current power source sees diode (103) passing a supply of current to capacitor (104) maintaining DC conditions for ultimately the proportional water temperature signal (134), the proportional water temperature rate of change signal (132) and the adjustment offset signal (131) to wherein the combined proportional water temperature rate of change signal (132) and the adjustment offset signal (131) provide for signal (135) inputted into the comparator (45) of the integrated circuit (12).

Resistor (105) and capacitor (106) provide a time delay which is able to disconnect the adjustment offset signal (131) from interfering with the initial duty cycle being sent to the TRIAC (20) to bring the heating element up close to its set temperature level.

The time delay capacitor (106) and resistor (105) are working with operational amplifier (108) wherein non-inverting input (151) and inverting (107) produce the necessary signal (153) which passes through resistor (125) in order to switch on and off as required the MOSFET (136) connected to the offset OpAmp (126).

Resistor (122) and capacitor (127) establish the gain potential for the OpAmp (126).

Both the offset adjustment signal (131) and the proportional water temperature rate of change signal (132) pass through their respective resistors (133) and (161) where they are combined to present input signal (135) to the comparator (45) of the integrated circuit (12).

Signal input (135) is comparatively read with input signal (134) which is the derived proportional water temperature signal stemming from signal (155) from the amplifier (118) which takes the dual sensed temperatures from the negative temperature coefficient thermistors (56) and (156) which is fed into a non-inverting input of amplifier (118), and read with the inverting signal established in part from resistors (115) and (117), which are used to set the gain of the proportional water temperature signal amplifier (118).

The output from the amplifier (118) read as (155) is the proportional water temperature signal which passes through resistor (120) to the input (134) into the comparator (45) of the integrated circuit (12).

The signal is also fed through as signal (157) through a series configured capacitor (123) into the OpAmp (130) through the inverting input wherein the referenced input (159) is derived from the voltage by the resistors (121) and (124) with the output from the comparator (130) providing signal (132).

The OpAmp (130) has an established operating gain and in part is in communication with capacitor (157) and resistor (129).

Line (159) passing through resistor (128) provides a non-inverting input into the offset of OpAmp (126) which provides the adjustment offset signal wherein the output from the OpAmp (130) of the proportional water temperature rate of change signal can then be fed back into the OpAmp that is establishing the adjustment offset signal.

Preferred resistor and capacitor values are: resistors (48) 2M4, (40) 430 kΩ, (50) 39 kΩ, (38) 75Ω, (74) 910 kΩ, (101) 100 kΩ, (105) 7M5, (109) 390 kΩ, (119) 43 kΩ, (117) 100 kΩ, (115) 430 kΩ, (120) 240 kΩ, (124) 390 kΩ, (122) 220 kΩ, (121) 390 kΩ, (133) 1M5, (161) 220 kΩ, (128) 220 kΩ, and (129) 1M5 and capacitors (104) 100 μF, (106) 2μ2, (123) 2μ2, (127) 1 μF and (68) 100 μF.

Figure 2:
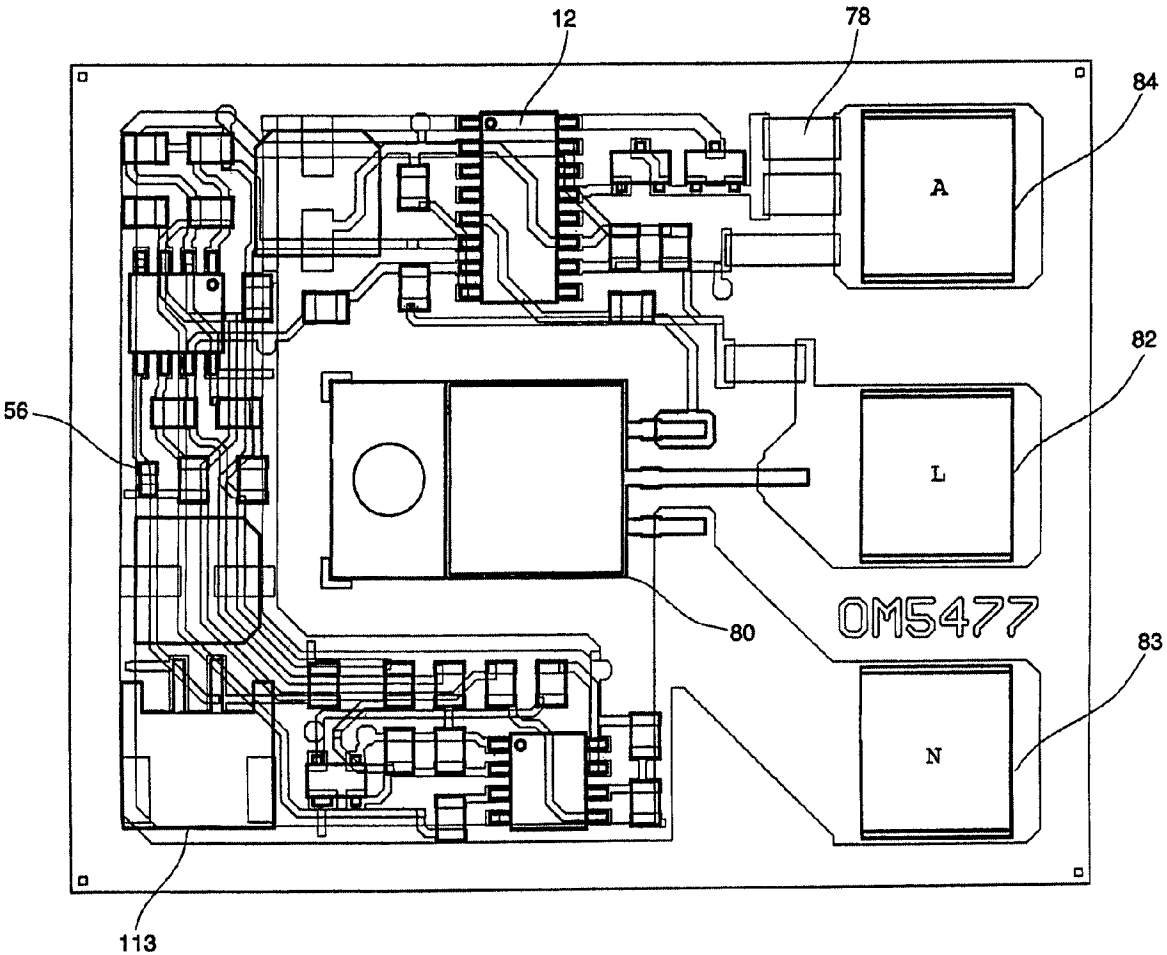
FIG. 2 is a perspective view of the circuit arrangement deposited on a ceramic substrate.

FIG. 2 shows the arrangement is mountable upon a ceramic substrate and so too using a thick film printing process to deposit the necessary circuit (78) connections to the resistors, capacitors and TRIAC (80) as well as power connection terminals (83) and (84) and element connection terminal (82) to the ceramic substrate. Component (113) in FIG. 2 is a connector (header) for connection of the 2nd temperature sensor (156) used to detect inlet water temperature.

Figure 3B:
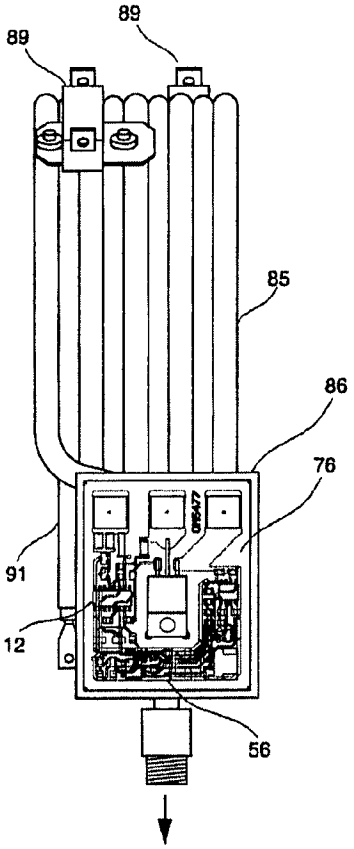
FIGS. 3*a* and 3*b* are front and side views respectively showing the ceramic substrate with the deposited circuit arrangement printed thereon mounted to a backing metal plate which is then attached to the outlet piping of the instantaneous hot water heater unit.
Figure 3A:
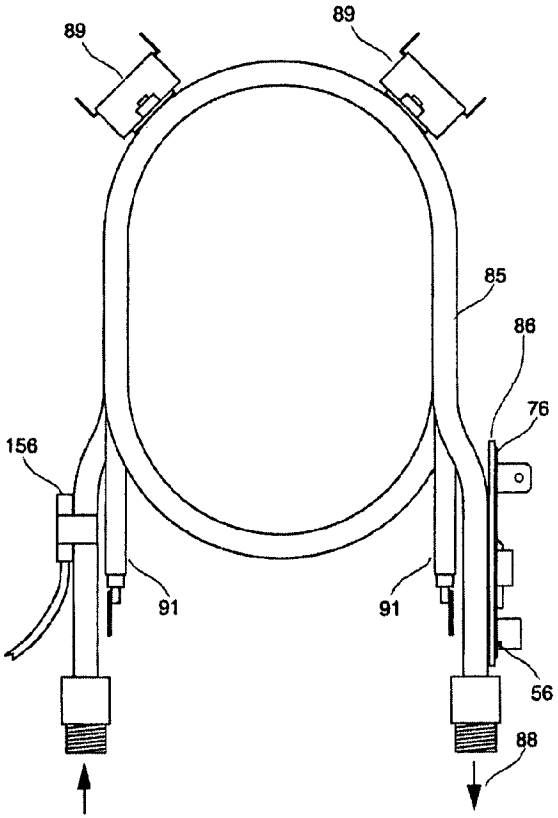
Figure 4:
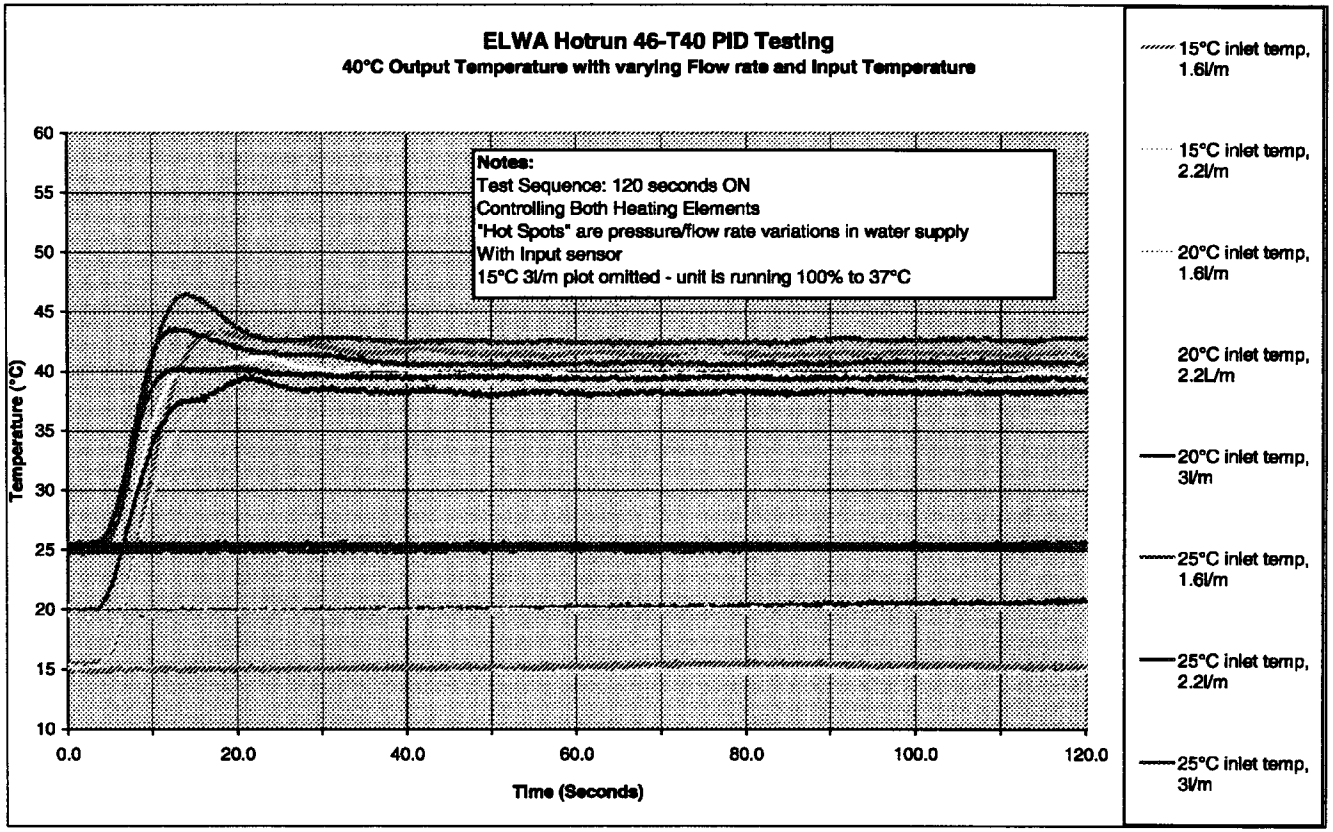
FIG. 4 is a temperature plot for 4.6 kW heater with 40° C. PID controller.
Figure 5:
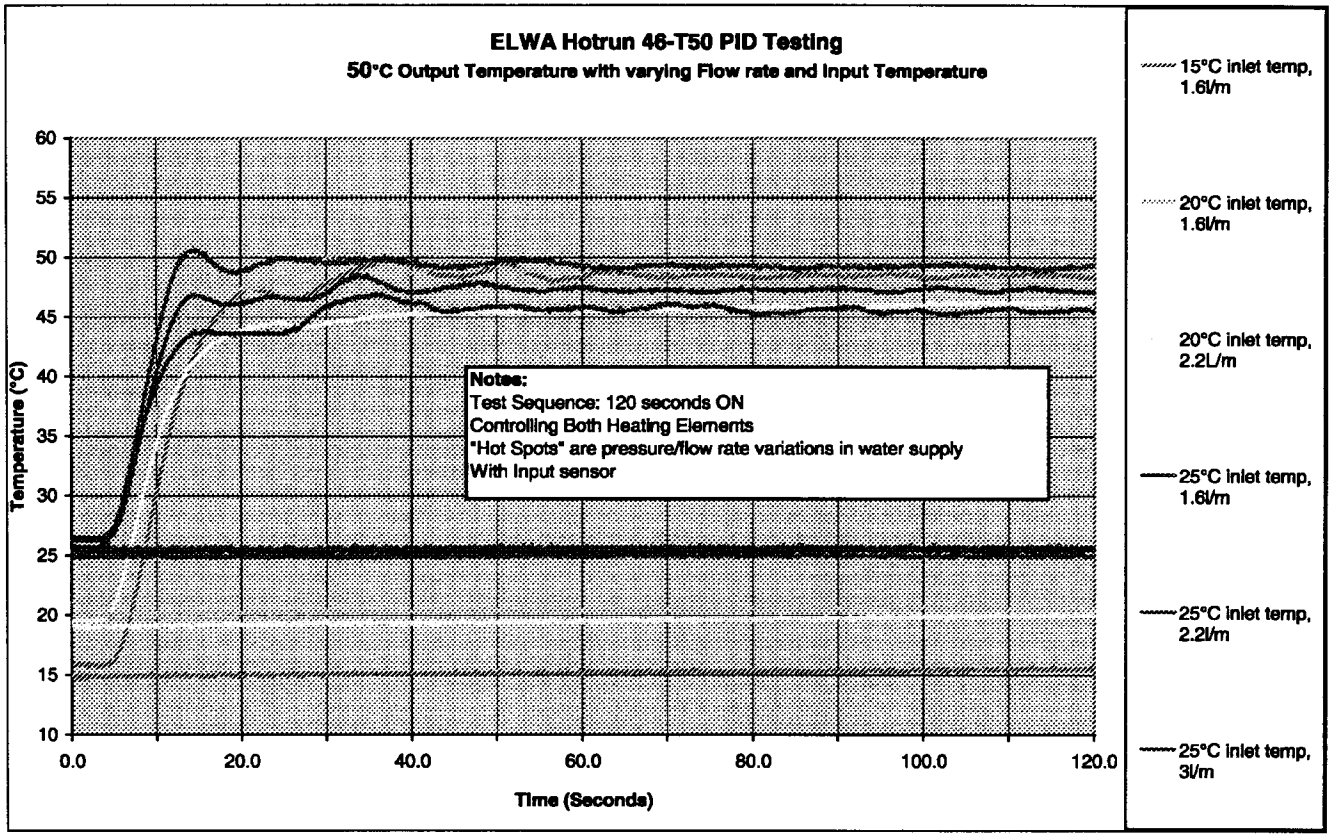
FIG. 5 is a temperature plot for 4.6 kW heater with 50° C. PID controller.
Figure 6:
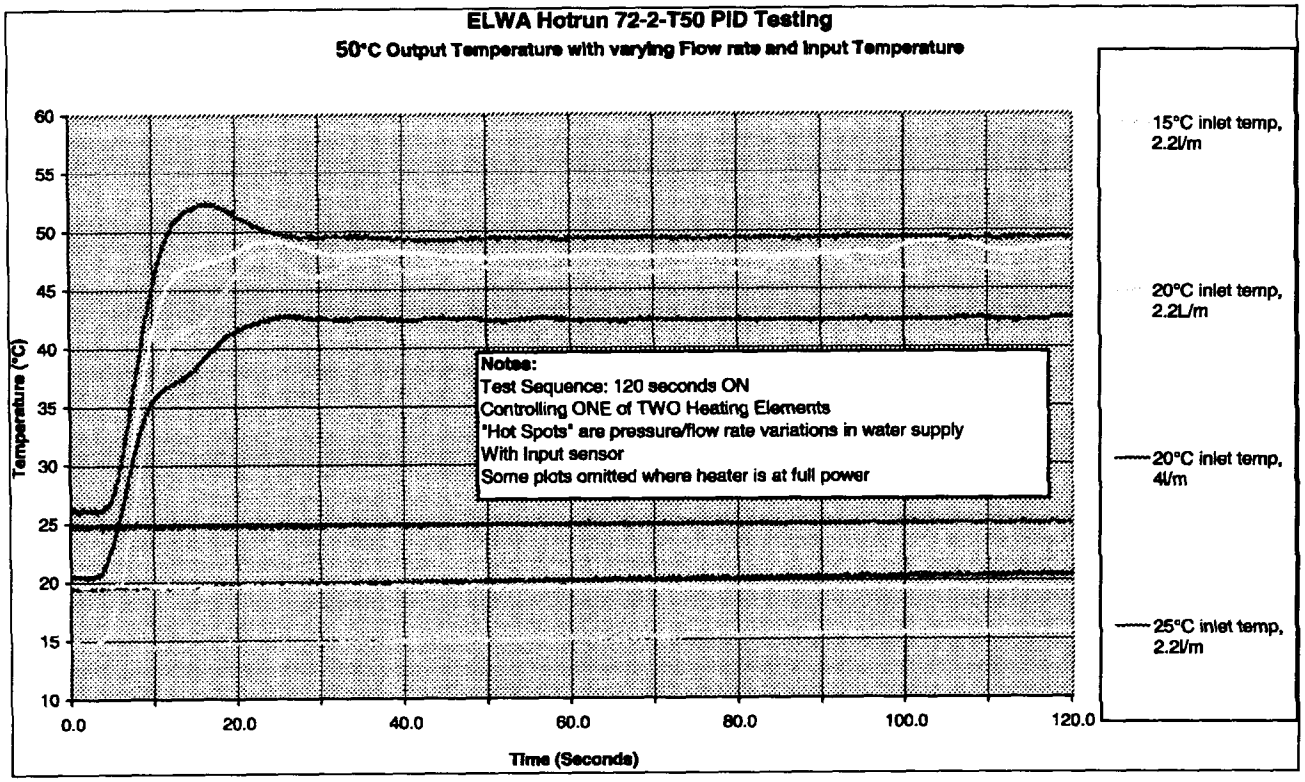
FIG. 6 is a temperature plot for 7.2 kW heater with 50° C. PID controller.

The benefits of the use of the ceramic circuit board were discussed above but as seen in FIGS. 3*a* and 3*b* the ceramic circuit board (76) can be mounted to the backing plate (86) and then attached to the piping arrangement (85) where water flows therethrough in order to be heated such that upon discharge (88) the temperature through the utilization of the circuit arrangement provided for in this invention at a set sustained temperature value or range.

A plot of the test results for controlling one element of the dual element 4.6 kW unit with a control temperature of +40° C. is shown below in chart 1, while chart 2 shows the results from the same 4.6 kW unit with a control temperature of +50° C. Similarly chart 3 is for a higher power 7.2 kW unit, where only one of the two heating elements is controlled.

In each of the figures mentioned, a family of curves is provided for inlet water temperatures of +15° C., +20° C. and +25° C., achieved using a combination of the chiller and second series heater. A range of flow rates is also used; 1.6 l/m, 2.2 l/m and 3 l/m for the 4.6 kW unit, while for the 7.2 kW unit flow rates of 2.2 l/m and 4 l/m have been used.

The results show a marked improvement over the linear control described in FIGS. 1*a* and 1*b*. In all cases overshoot at turn-on is virtually eliminated. The small overshoot that occurs for a +50° C. temperature setting at the highest inlet water temperature (+25° C.) and lowest flow rate is low enough, and of short enough duration that it meets the requirements of the standard.

There still remains some spread in final control temperature, but experimentation has shown that any attempt to reduce the spread of (long-term) control temperature, which is typically done by increasing the affect (ie. gain) of the Integral (integrated error or offset adjustment) signal, simply results in oscillation of the control temperature. The spread of temperatures shown in each case appears to be the best result before inducing oscillation. The final temperature error appears to be around ±2° C. about the nominal target control temperature.

For the +50° C. models, the target temperature is actually reduced to +48° C., to ensure that the steady-state temperature never exceeds the maximum +50° C. limit. This means that the control temperature for these models will actually be +48° C.±2° C.

Given that the main application for these heaters is for personal hygiene (washing hands) in the hospitality industry, an accuracy of ±2° C. is deemed acceptable.

The invention claimed is:

1. An arrangement of electric signals adapted to sustain water discharging from an instantaneous hot water heating unit at a set temperature or range, the arrangement including:

a proportional water temperature signal derived from a sensing arrangement wherein said sensing arrangement is in communication with both a water inlet port and an outlet port so as to sense the respective temperatures at each port so as to provide a comparatively measureable proportional difference between the inlet and outlet temperatures set against referenced parameters;

a proportional water temperature rate of change signal derived from the water proportional temperature signal comparatively referenced with short term rate of change parameters of said proportional water temperature signal;

an adjustment signal derived from said proportional water temperature signal comparatively referenced with an offsettable pre-determined parameter;

a comparator;

a first input into said comparator derivable from the proportional water temperature signal;

a second comparator input derived from the summing together of both the proportional water temperature rate of change signal and the adjustment signal, such that the comparative relationship between the first and second input signals to the comparator provide an operable control of a switch adapted to couple and de-couple an alternating current power source to a heating element of the instantaneous hot water heating unit so that when the switch is in an 'on' state, the heating element is coupled to the alternating current power source and conversely when the switch is in an 'off' state, the alternating current power source is de-coupled from the heating element whereby the signal established from the comparator derives from the first and second input signals provides a duty cycle of highs and lows that is translated by the switch to a switching time sequence of 'ons' and 'offs' at a rate to generate and maintain the appropriate coupling and/or de-coupling of the alternating current power source to and from the heating element to achieve a referenced temperature and/or temperature range.

2. The arrangement of claim 1 wherein the proportional water temperature signal, the proportional water temperature rate of change signal and/or the adjustment signal are DC derived.

3. The arrangement of claim 2 wherein DC conditions for the proportional water temperature signal, the proportional water temperature rate of change signal and the adjustment signal are provided for by a Zener diode.

4. The arrangement of claim 3 wherein the Zener diode is between an active terminal of the alternating current power source and the comparator.

5. The arrangement of claim 4 wherein the Zener diode is reversed biased against the active terminal of the alternating current power source and working in conjunction with a series configured resistor.

6. The arrangement of claim 5 wherein a diode is placed in parallel between the Zener diode and the series configured resistor so that positive half cycles of the alternating current power source are passed on to the DC operable portion of the arrangement.

7. The arrangement of claim 6 wherein current generated during the positive half cycle passing through the diode set parallel against the Zener diode and the series resistor stemming from an active cycle of the alternating current power source is in communication with a capacitor chargeable and dischargeable so as to provide required DC levels in between the positive half cycles of the alternating current power source.

8. The arrangement of claim 1 further including negative temperature coefficient thermistors adapted to sense water at each of the water inlet port and outlet port respectively.

9. The arrangement of claim 8 wherein the inlet and outlet water temperatures proportionally conditioned are then fed into an amplifier.

10. The arrangement of claim 9 wherein the negative temperature coefficient thermistors would have approximate ratings of 47 k at 25° C.

11. The arrangement of claim 1 wherein the adjustment signal is in operable communication with a time delay arrangement once the alternating current source is first coupled to the heating element for heating.

12. The arrangement of claim 11 wherein the time delay arrangement includes a capacitor and a resistor whereby the time of the delay will be determined by the values of both the capacitor and resistor.

13. The arrangement of claim 1 configured using a thick filmed printing process, wherein the arrangement is deposited on a ceramic substrate.

14. The arrangement of claim 13 wherein the ceramic substrate of the deposited arrangement for the invention is mountable on a metal plate.

15. The arrangement of claim 14 wherein the metal plate is attached to an outlet of the water pipe extending from the instantaneous hot water heater unit.

* * * * *